United States Patent [19]

Van Doorn et al.

[11] Patent Number: 4,497,085

[45] Date of Patent: Feb. 5, 1985

[54] APPARATUS FOR FEEDING MODULES OF SEED COTTON INTO DISPERSER APPARATUS

[75] Inventors: Donald W. Van Doorn; James B. Hawkins; Tommy W. Webb; William A. Harmon, Jr., all of Columbus, Ga.

[73] Assignee: Lummus Industries, Inc., Columbus, Ga.

[21] Appl. No.: 433,687

[22] Filed: Oct. 12, 1982

[51] Int. Cl.[3] ..... D01G 7/08; D01B 1/38; B02C 9/04

[52] U.S. Cl. ..... 19/80 R; 19/97.5; 241/101 A

[58] Field of Search ..... 19/80 R, 69.5, 97.5, 19/81; 241/223, 101 A; 198/804

[56] References Cited

U.S. PATENT DOCUMENTS

| | | | |
|---|---|---|---|
| 2,637,457 | 5/1953 | Barrett | 198/804 X |
| 2,724,169 | 11/1955 | Taylor et al. | 19/80 R X |
| 2,938,239 | 5/1960 | Leineweber, Jr. et al. | 19/80 R |
| 4,035,869 | 7/1977 | Wilkes et al. | 19/97.5 X |
| 4,057,876 | 11/1977 | Sawyer | 19/80 R |
| 4,077,531 | 3/1978 | Van Doorn et al. | 19/80 R X |
| 4,190,933 | 3/1980 | Jagst | 241/101 A X |
| 4,192,042 | 3/1980 | Jagst | 241/101 A X |
| 4,202,079 | 5/1980 | Prather | 19/80 R X |

*Primary Examiner*—Louis K. Rimrodt
*Assistant Examiner*—J. L. Kravitz
*Attorney, Agent, or Firm*—Woodford R. Thompson, Jr.

[57] ABSTRACT

Disclosed is apparatus for feeding modules of seed cotton to disperser apparatus. The apparatus is capable of picking up, moving and delivering to the disperser the modules of cotton to be ginned, and further is constructed and arranged to load or discharge modules from either end of the apparatus and to run under a module or modules, thereby to reach one located more distantly from the disperser than the others. Also disclosed are various controls and safety devices for the apparatus.

16 Claims, 21 Drawing Figures

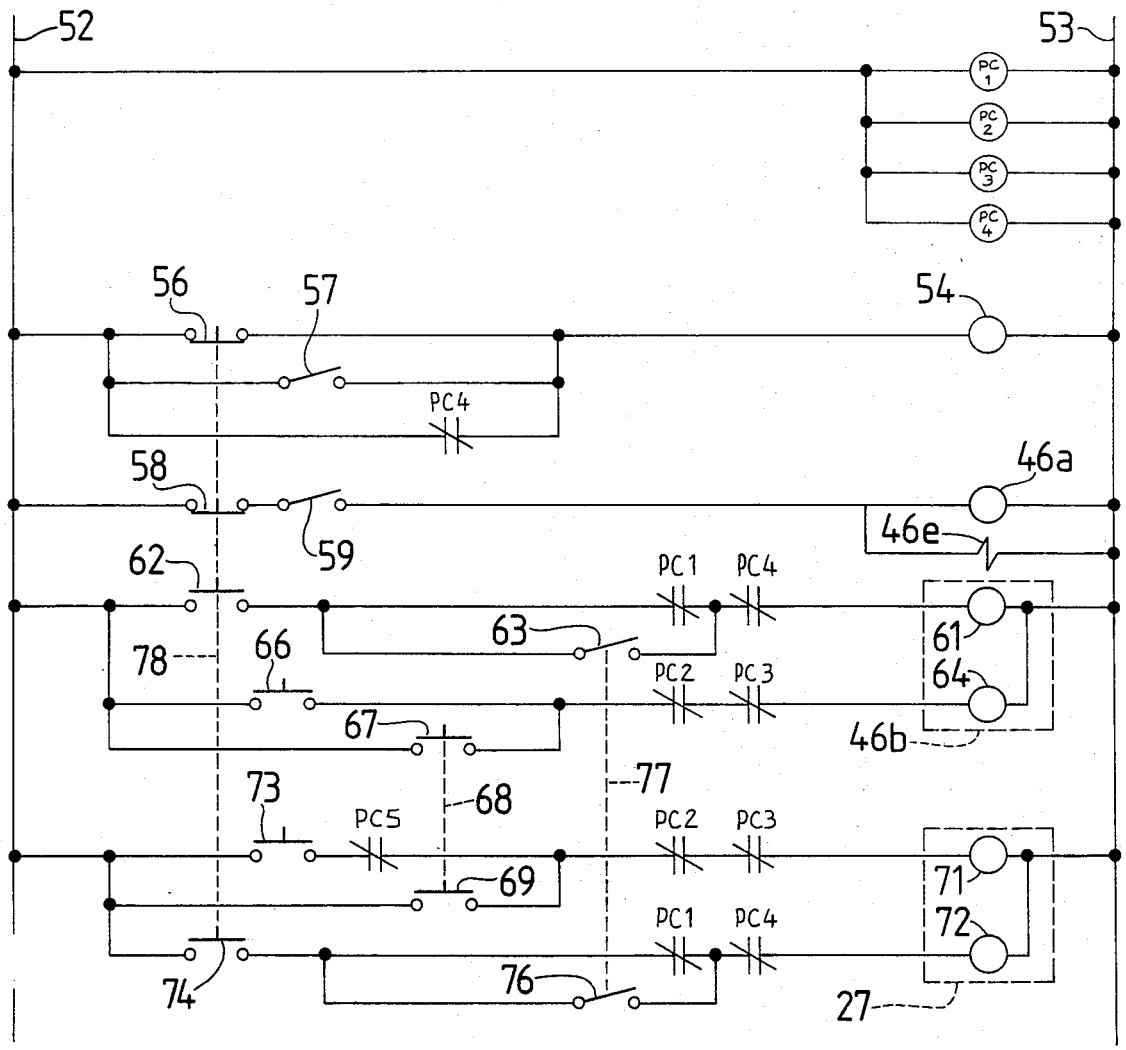
Fig. 20
Fig. 21
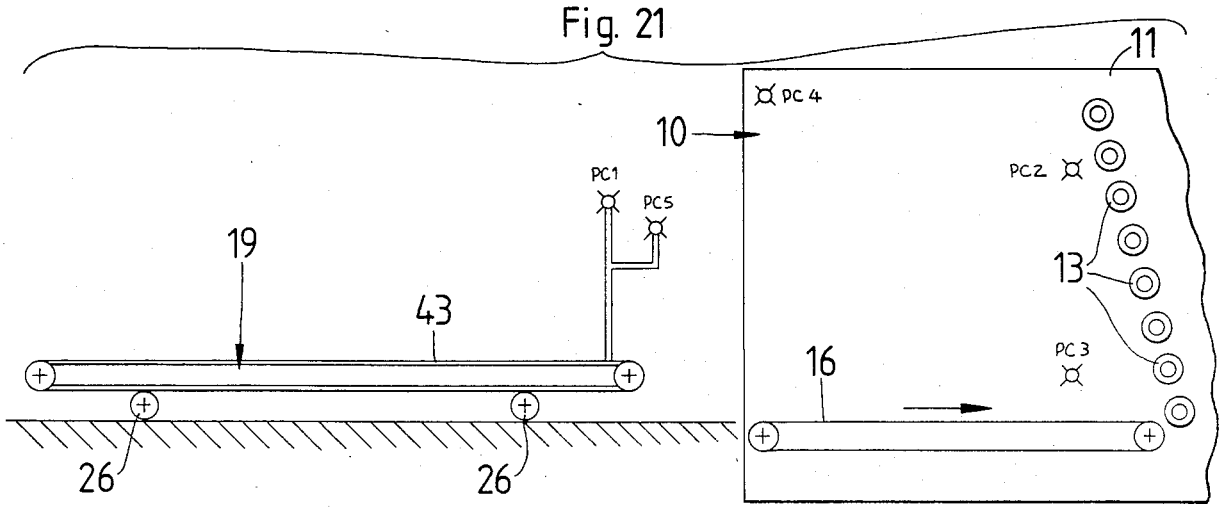

APPARATUS FOR FEEDING MODULES OF SEED COTTON INTO DISPERSER APPARATUS

GENERAL NATURE OF THE INVENTION

This invention relates to apparatus for feeding modules of seed cotton or the like into disperser apparatus which breaks the modules down into locks or groups of locks and feeds them to a gin.

BACKGROUND OF THE INVENTION

In the field to which our invention relates there are, generally stated, two types of apparatus presently used for feeding modules of seed cotton to disperser apparatus. First, there is the so-called stationary type of apparatus in which a disperser unit is fixed on a foundation and the modules are fed endwise into such apparatus by means of conveyor chains or belts. The modules to be fed are deposited onto the elongated chains or belts by transport trucks which pick up the modules from the field and deposit them onto such belts or chains. Second, there is the so-called traveling module disperser in which the disperser itself is mounted for reciprocation along a row of modules placed end-to-end on a stationary receiving surface such as a concrete slab. Both of the above mentioned types of apparatus have their advantages and their disadvantages. With regard to the stationary or fixed head feed systems, these enable the seed cotton to be fed full width, that is, approximately 8 to 10 feet wide, into stationary extracting or cleaning systems or directly into a drying system. The traveling head units must first convey the cotton crossways of the disperser then onto a long narrow belt running the full length of whatever number of modules might be in the row. The principal advantages of the moving head module feed system are its low cost and its ability to run through several modules without requiring the services of a module mover. The stationary module feed systems have the advantage of being able to run continuously without ever coming to the end of a long row of modules. Once at the end of a row of modules there necessarily is a period of cessation of feed to the gin plant when using the moving disperser systems. It is desirable to move the heavy bulk trash from the seed cotton immediately after it has been plucked into a loose stream at the dispersing cylinders. Many of the traveling dispersers, as well as the stationary disperser units, are equipped with cleaning apparatus mounted directly on the disperser to remove this bulk trash. In the case of the stationary disperser system this trash can be immediately conveyed away from the stationary point of trash discharge. With the traveling disperser head units, trash must first be conveyed across the disperser, then onto a long trash conveyor that must run the full length of whatever number of modules are to be processed in a row, and finally bring the trash to a stationary point where it is carried away. In addition to the above, various sensing means to measure the conditions of the modules just before they are fed into the disperser are desirable. With the stationary module disperser system these sensors with their multitudinous conductors may be mounted stationary on the disperser housing. With the traveling disperser units, all of the electrical and other signals from these sensors and the input signals to the sensors must be run through cables that somehow are telescoped in and out along the full length of the modules to be processed. Some low voltage signals cannot be carried long distances without loss of quality.

Of course, the power to the traveling disperser head must be carried through telescoping cables also.

OBJECTS OF THE INVENTION

Our invention has for an object the provision of apparatus for conveying modules of seed cotton to a disperser unit which shall, in general, overcome many of the above objections noted with regard both to the stationary and movable disperser systems. One object of our invention is to provide apparatus which shall permit the deposition at a module receiving station adjacent a fixed module disperser, within the storage capacity of the receiving station, an unlimited number of end-to-end modules, together with apparatus which shall be effective to feed said modules endwise into the disperser.

A further object of our invention is to provide a module pick-up and mover capable of feeding a given module endwise into the disperser unit, but which also is capable of receiving a module and discharging a module from either end thereof, thereby permitting the apparatus to shuttle along the receiving station, thus maintaining empty spaces at the end of the receiving station remote from the disperser unit, thereby permitting immediate unloading of the modules which are brought from the field by the transport trucks.

Another object is to provide a module pick-up, moving and discharging device for the disperser unit which shall be so constructed and arranged and so sized as readily to permit it to run under, lift and move a module and further so constructed and arranged that a module may be received at either end or discharged from either end, together with means to vary both the rate or speed at which the device receives and discharges a module.

Another object is to provide a module pick-up, moving and discharging device including on its upper surface longitudinal powered conveying means and mounted on powered wheels and equipped with means to coordinate the relative speed and direction of said conveying means and wheels with the result that modules may be picked up and discharged from either end and conveyed onto and off from the top surface of the device without substantially distorting the module.

A still further and more general object is to provide apparatus which permits the ginning of modules of seed cotton as they are delivered, generally intermittently, from the fields, without delaying the turn around time of the transport vehicles and without the necessity of stopping the gin due to lack of modules to be fed thereto, both being accomplished without the necessity of double handling the modules, namely, bringing them from the fields, stacking them on the gin yard, and then placing them into position to be fed to the disperser.

Another object of our invention is to provide apparatus having the features above set forth in which the receiving station for the modules may be a simple, inexpensive concrete slab with tracks thereon for our apparatus to run upon, thereby eliminating the expense of moving conveyors for feeding the modules into the disperser unit.

GENERAL DESCRIPTION OF THE INVENTION

Generally stated, our improved apparatus comprises a low profile, wheel mounted vehicle. Mounted on the vehicle is a conveyor for supporting modules of seed cotton. Electric motors and controls therefor are provided to cause the vehicle to traverse on its tracks, which tracks are laid out in front of the module disperser unit and to cause the conveyor to run at such speed relative to movement of the vehicle as to pick up a module or discharge the same. As before stated, with regard to ability to pick up and discharge the module, both ends of our improved feeding apparatus are identical. That is to say, our improved vehicle is capable of running under a module from either end of the vehicle, lifting the module, from one end, and discharging the same either from the end upon which it was loaded or from the other end. This feature permits not only feeding of a given module to the disperser unit, but also permits our apparatus to move the last delivered ones of the modules to positions closer to the disperser unit, thereby providing room at the receiving station for the module transport trucks to deposit other modules, thereby, overall, accomplishing the objects of full utilization of the module transport units as well as the gin plant. Other detailed improvements with regard to the construction and use of our improved apparatus will appear as the description proceeds.

DESCRIPTION OF THE DRAWINGS

Apparatus embodying features of our invention is shown in the accompanying drawings, forming a part of this application in which:

FIG. 20 is a wiring diagram of our improved apparatus; and,

FIG. 21 is a diagrammatic view showing portions of the disperser unit control mechanisms showing in diagrammatic manner the module transport vehicle nearing a position to deposit a module of cotton onto the receiving conveyor of the module disperser unit.

DETAILED DESCRIPTION OF THE DRAWINGS

Figures 1, 2, 3, 4, 5:
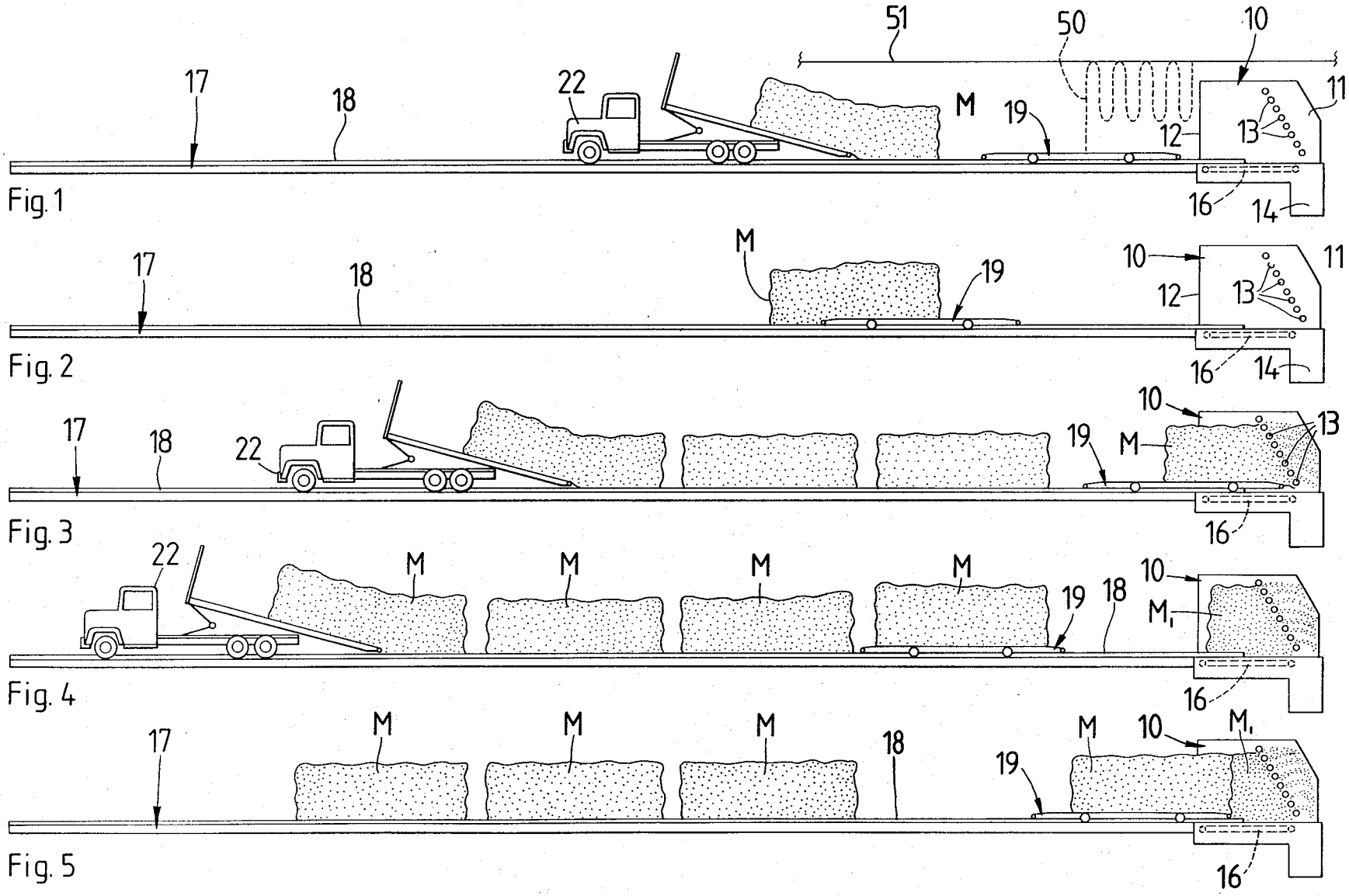
FIGS. 1 to 10 inclusive are diagrammatic or schematic views illustrating apparatus in association with a fixed module disperser and showing the method of using the same both for feeding modules to the module disperser unit and for moving modules deposited at the receiving station to positions closer to the module disperser, providing space for the unloading of additional modules by the transport trucks.

Referring now particularly to FIGS. 1 to 10 inclusive of the drawings, we show our improved apparatus in association with a fixed type module disperser unit indicated generally by the numeral 10. The disperser unit comprises a housing 11 which has an opening 12 at the front or module receiving side of the housing. The housing is of such dimensions as to receive a module M of cotton. A series of disperser rollers or workers 13, mounted generally as shown and driven, contact the end of a module presented thereto and disperse or separate the module so that the cotton to be ginned is discharged from the apparatus 10, generally downwardly through a chute or the like 14 from whence it is fed to the gin by cross feed belts, not shown. The module disperser also contains a driven belt 16 wide enough and long enough to receive a length of a module and to feed it into the disperser rollers 13. For a detailed description of a form of fixed disperser unit with which our invention may be employed, see U.S. Pat. No. 4,077,531.

Extending outwardly from the module disperser, namely, in front of the same, is a module receiving station 17. This may be a concrete slab poured either directly onto the earth, generally somewhat elevated. Embedded in or otherwise secured to the slab 17 is a pair of tracks 18 which are of a minimum height above the concrete slab, as clearly shown in FIGS. 1 through 12, 18 and 19, so that the top of the supporting surface and the tops of any track sections are located at substantially the same elevation whereby modules deposited on the supporting surface out of alignment with the travel of the vehicle can later be pushed laterally across the supporting surface into alignment with the vehicle. It is upon these tracks that our improved module lifting, transporting and discharging vehicle is adapted to run, the same being indicated generally by the numeral 19 in FIGS. 1 to 10, inclusive. With the understanding that the details of our improved vehicle 19 will be later described, we will now go through a sequence of operation of the same by reference to FIGS. 1 to 10, thereby to explain the advantages that flow from the construction to be later described in detail.

First, it will be understood that our improved vehicle is a powered one, and that the same preferably is powered by electrical motors. Still further, there are various controls which cause the vehicle to move up and down the tracks and also at desired rates of speed. Still further, our improved vehicle is equipped with a live deck, namely a series of chains or the like indicated at 21 in the drawings to support the module M. These chains also are powered, as will later appear, in such fashion that they may be driven in either direction, at varying speeds, and in timed relation with regard to the linear motion of the entire vehicle which carries them. Thus, the chains are capable of in effect standing still relative to the horizontal movement of a module M while the vehicle itself moves under such module, thereby lifting and loading the module onto the vehicle. Further, such speeds may be regulated when discharging the module, it being understood that these modules are fairly fragile and that pushing, pulling or tugging on them may cause a breakage of the same and loss of cotton therefrom.

First, and viewing FIG. 1, it is assumed that the module feeding vehicle 19 is in the position shown, namely, close to the disperser unit 10 and that a truck 22 is delivering a module M from the field and depositing the same directly onto the receiving station 17. It will be noted that the truck 22 may be immediately unloaded so that it is to immediately return for another module. The next sequence is for the operator to power our improved module pick-up and feed vehicle 19 so that it runs under and lifts a module onto itself. This module M is now moved to and fed into the disperser unit by our improved vehicle 19 as shown in FIG. 3. In the meantime, the truck or trucks 22 are free to deliver onto the station 17 additional modules M as shown in FIG. 4. As soon as enough of a complete module is fed to the unit 10, the remnant $M^1$ thereof can be dropped onto the conveyor 16 forming part of the apparatus 10, whereupon, the vehicle 19 is now free to move again as shown in FIG. 4, to a position to run under and lift, ready for transport, another module M. The vehicle 19 then moves again toward the module disperser unit 10, as shown in FIG. 5, pushing the end of the second module against the end of the remnant $M^1$ of the first named module, providing a continuous supply of cotton to the disperser unit and consequently to the gin.

Figures 6, 7, 8, 9, 10:
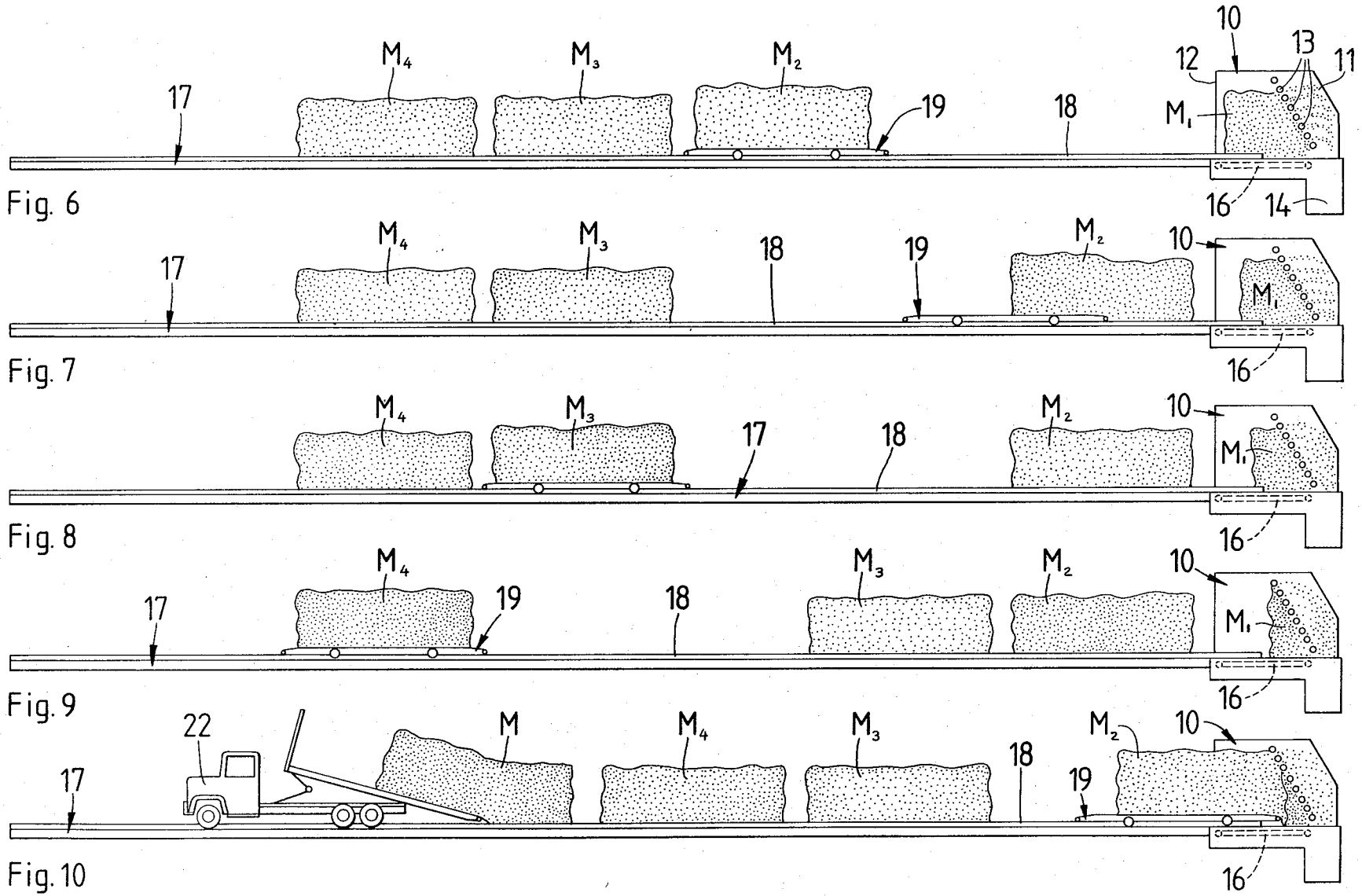
Figure 11:
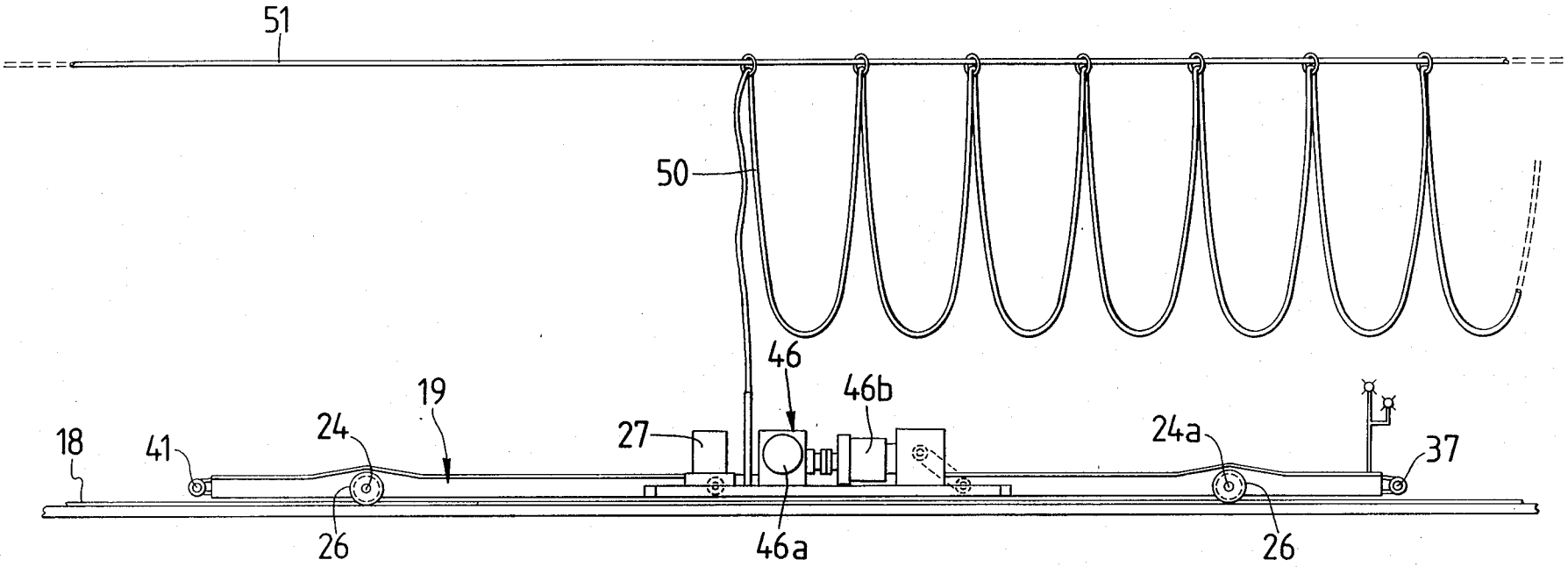
FIG. 11 is a somewhat diagrammatic side elevational view of our improved vehicle or apparatus.
Figure 12:
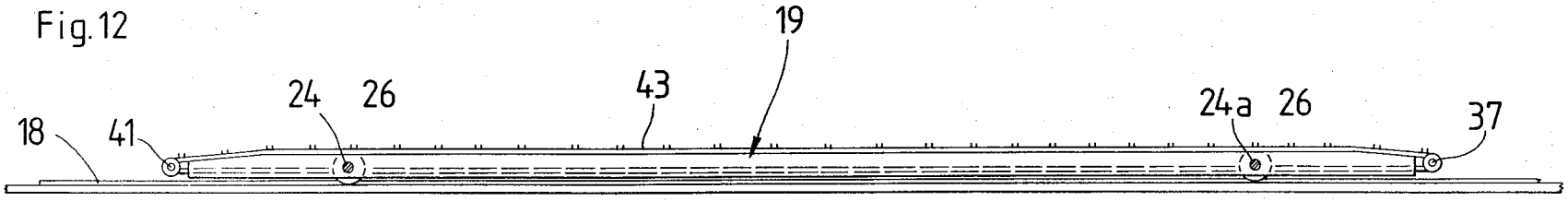
FIG. 12 is a somewhat diagrammatic sectional view taken generally along line 12—12 of FIG. 13.
Figure 13:
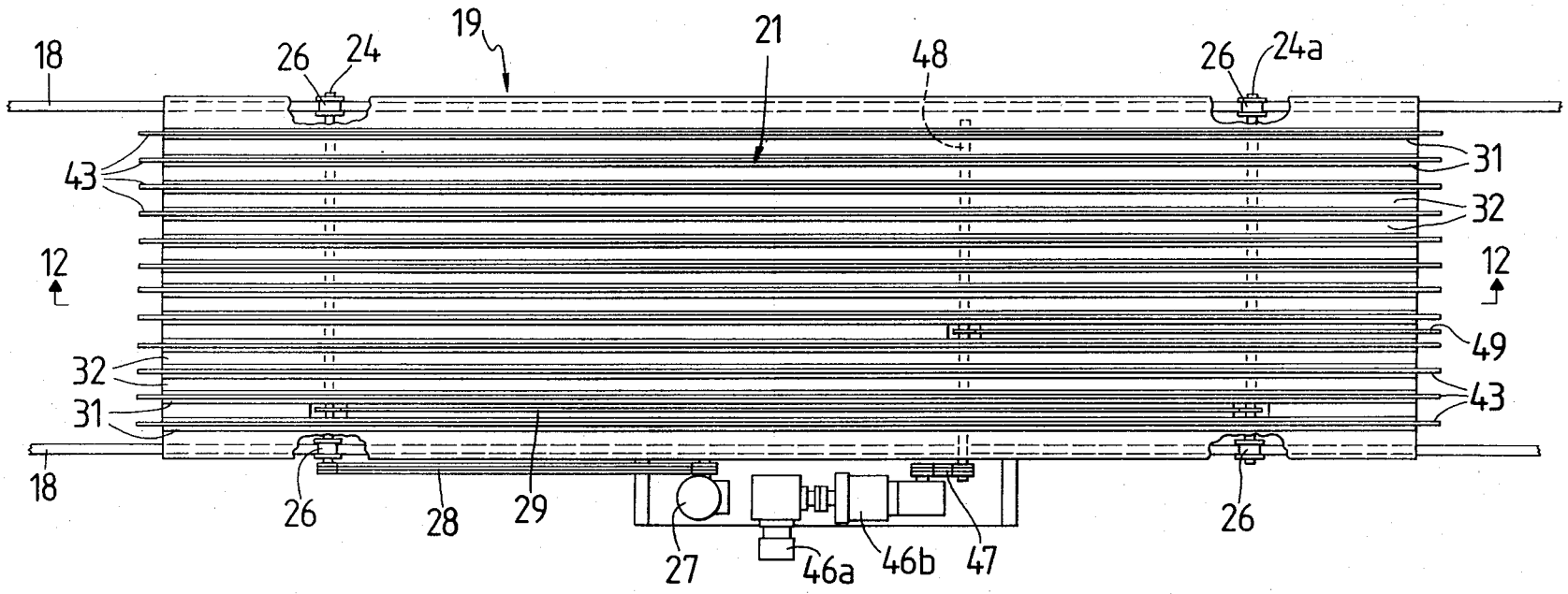
FIG. 13 is a somewhat diagrammatic plan view, certain parts being broken away and omitted for the sake of clarity, and showing our improved apparatus mounted on tracks forming part of the module receiving station.

Referring now to FIGS. 6 to 10 it will be seen that in the event the receiving station 17 has been completely loaded by the field transport trucks 22, our improved vehicle 19 may be used to shuttle the modules M to a position closer to the disperser unit 10, providing room for the unloading of additional modules from the field. Thus, as shown in FIG. 6, while the remanant $M^1$ of a module is being finally dispersed, our improved apparatus can run under, lift and transport the next module $M^2$ closest to the unit 10 from the position of FIG. 6 to the position of FIG. 7. Similarly, the other modules $M^3$ and $M^4$ as shown in FIGS. 8 and 9 can be moved from their unloaded positions closer to the disperser 10. Our vehicle 19 is now driven to unload $M^4$, pass under $M^3$ and load $M^2$ and start feeding it to the disperser as shown in FIG. 10. The transport truck or trucks 22 may now again replenish the row of modules. It will thus be seen that due to its ability to receive and discharge modules from either end our improved vehicle 19 is capable of keeping the disperser and hence the gin fully fed at all times while at the same time keeping the modules which have been unloaded from the field close enough to the disperser unit to permit the unloading at the receiving station of additional modules from the field. Also our improved apparatus allows a maximum reservoir of modules to be maintained at any time desired to permit a transport truck to make a long distance haul without causing the gin to shut down due to lack of module supply.

Referring now particularly to FIGS. 11 to 19 we now will describe more in detail the construction and operation of our improved vehicle 19. First, and as stated, our improved vehicle comprises axles 24 and 24$^a$ carrying flanged wheels 26 adapted to ride on the tracks 18. Axles 24 are powered as illustrated particularly in FIG. 14. That is to say, a motor-gearbox unit 27 drives the axle 24 through a series of belts or the like 28. Axle 24$^a$ is driven through a chain or the like 29 from a sprocket 30 carried on the axle 24.

The framework of our improved apparatus may comprise a series of box members 31, extending fore and aft and cross braced adjacent the top by plates 32. The axles 24 and 24$^a$ may be carried in bearings 33 appropriately mounted on plates 34 carried by the outermost ones of the members 31. Mounted in bearings 36 at the disperser unit end of our improved vehicle 19 is a shaft 37. At intervals along the shaft 37 and fixed thereon are sprockets 38 which are in longitudinal centered alignment with the elongated members 31. At the opposite end of the vehicle similar bearings 39 rotatably support a shaft 41. Shaft 41 carries sprockets 42 similarly aligned with the members 31 and with the respective sprockets 38 at the opposite end of the apparatus.

Figure 14:
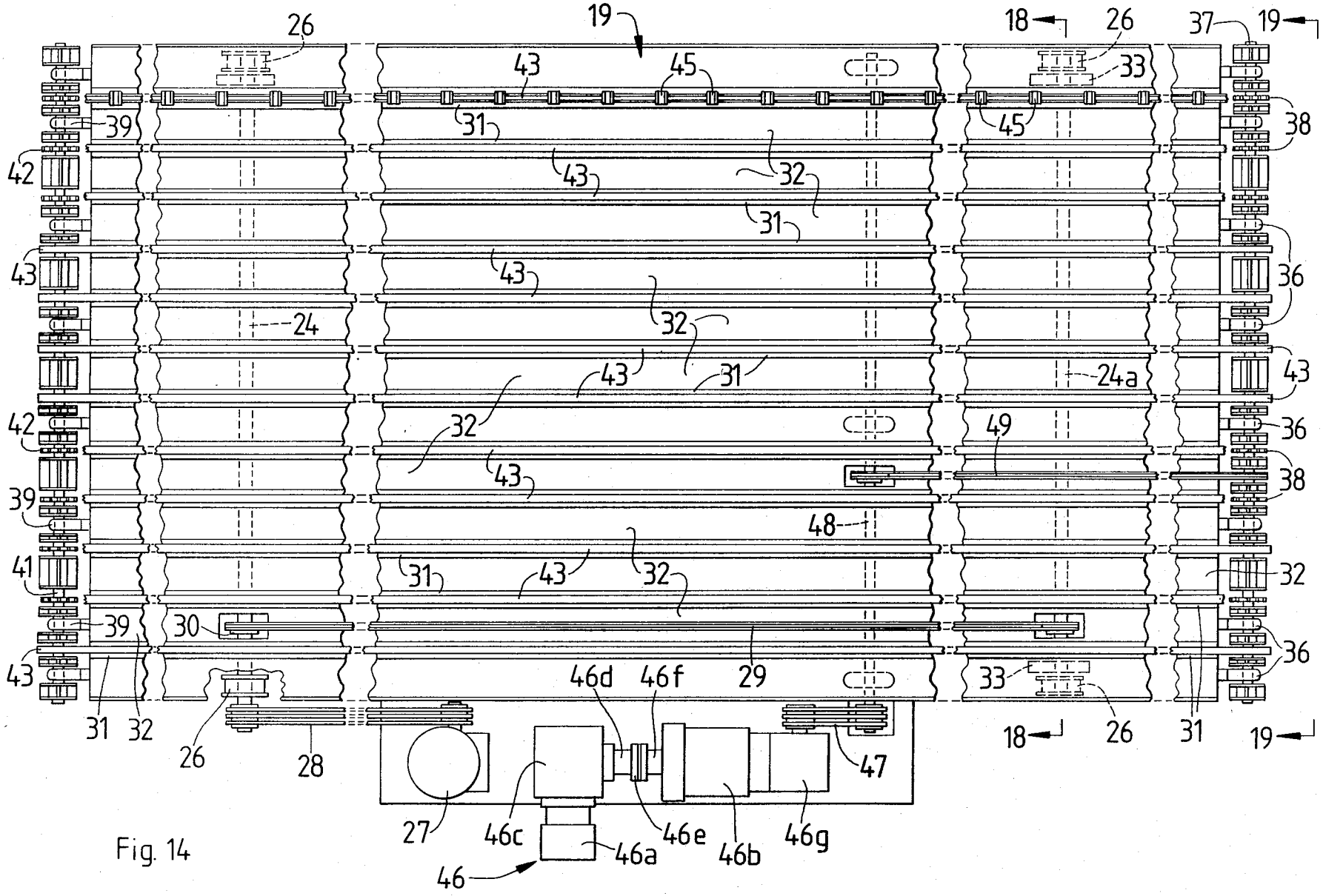
FIG. 14 is an enlarged fragmental plan view illustrating the drive for our improved apparatus and its module supporting and moving conveyor or live deck.
Figure 15:
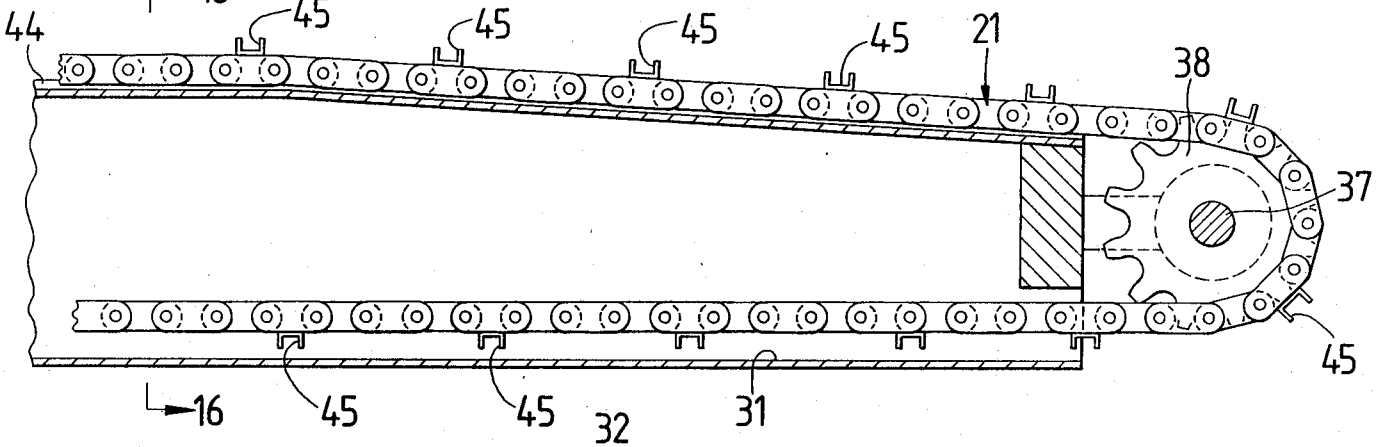
FIG. 15 is a fragmental sectional view on a vertical plane of one end of our improved module handling apparatus.
Figure 17:
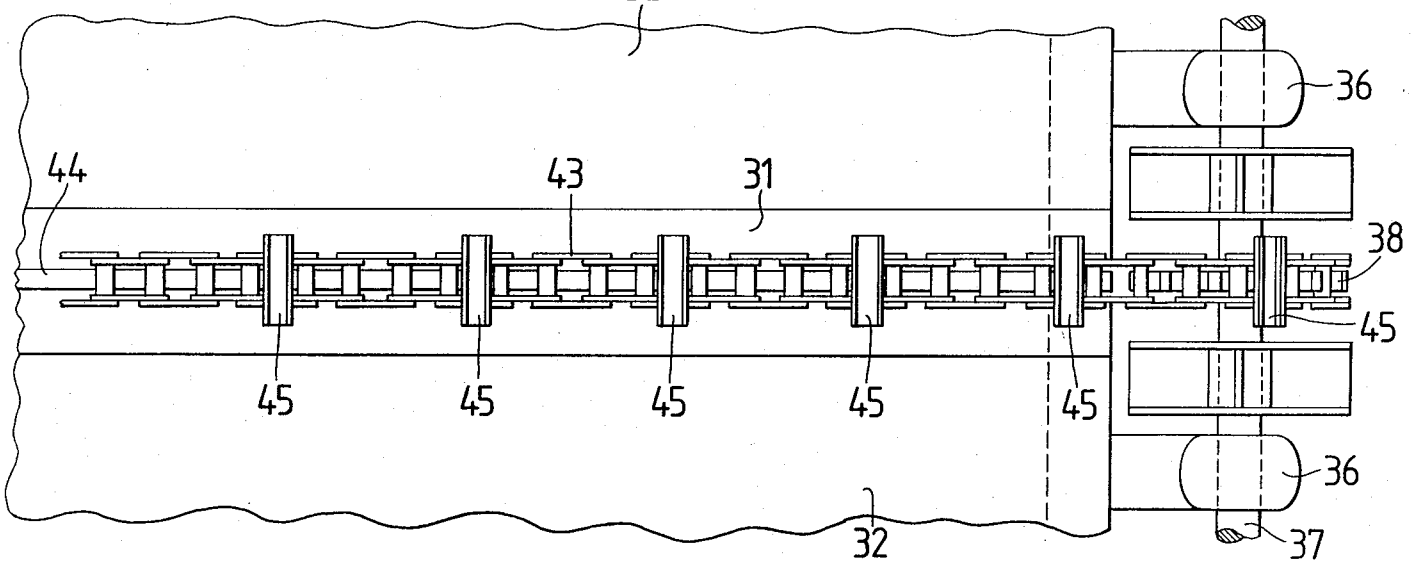
FIG. 17 is a plan view of the conveyor or live deck illustrated in FIGS. 15 and 16.
Figure 16:
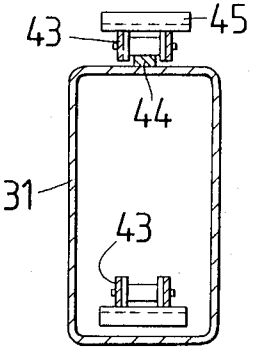
FIG. 16 is a sectional view taken generally along line 16—16 of FIG. 15.
Figure 18:
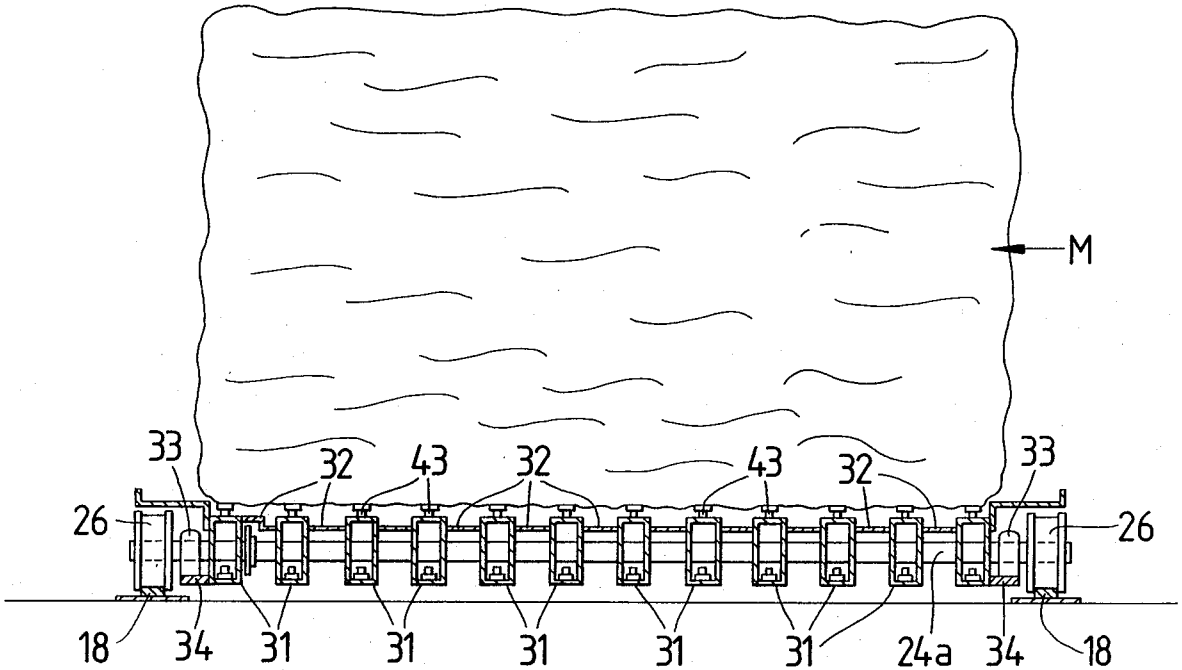
FIG. 18 is a detail sectional view taken generally along line 18—18 of FIG. 14 and illustrating a module in place on the supporting live deck of our improved apparatus.
Figure 19:
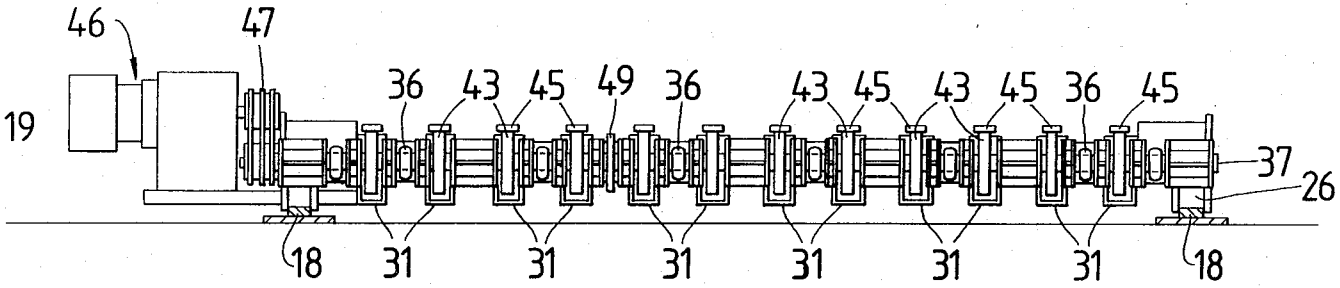
FIG. 19 is an end view taken generally along line 19—19 of FIG. 14.

Passing over the sprockets 38 and 42 are chains 43. As shown particularly in FIGS. 15 and 16 the upper flights of chains 43 have their roller elements supported on members 44 carried on top of the members 31. The lower flights of the chains pass through the tubular or hollow members 31 as illustrated. Attachments 45 may be provided on the chains for frictional engagement with the under side of the modules to be lifted and fed. As shown in FIG. 14, the shaft 37 carrying sprockets 38 is driven by means of a variable speed electric motor-transmission unit indicated generally at 46, through belts 47, a jack shaft 48 and a chain or the like 49. The shaft 41 is an idler shaft, being driven by the chains 43 of the live deck. It will be noted that the width of the entire live deck is sufficient to accommodate the entire width of a module of seed cotton and that the vehicle 19 is long enough to accommodate the entire length of a module. The drive motor 27 and drive unit 46 and their transmissions and gear boxes are located to the side of the vehicle so that the end of the vehicle 19 nearest the disperser will enter into the mouth of the disperser unit 10, as illustrated in, for instance, FIG. 3 of the drawing. Electric energy for the various motors and controls may be supplied by extensible cables indicated at 50 slidable along a support cable 51 stretched alongside the receiving station 17. From what has been so far described, it will be seen that our improved module lifting and feeding unit 19 is so shaped and sized as to be capable of running under the modules, from either end, lifting them, and moving them as already explained.

Referring now particularly to FIGS. 20 and 21 we will now describe the control system which may be used to control the motions of our improved module handler 19 up and down its track system together with suitable controls which may be used to control the supporting and feeding chains 43 of the live deck. These controls also are interrelated for the purpose of correlating the speed of the live deck with the translatory speed of the vehicle as a whole when required.

Carried on the vehicle, along the side thereof as diagrammatically shown in FIG. 21, are photocells PC1 and PC5. Mounted inside the housing of the disperser unit is a third photocell denominated PC4. Adjacent the rollers and further rearwardly into the housing is still another photocell PC2, while at the rear lower portion of the housing 11 just ahead of workers 13 of the disperser unit 10 is another photocell PC3. Each of these photocells may be of the self-exiting or self-contained type, namely, that type of photocell which carries its own exciting energy beam. Still further, while we show photocells it will be apparent to those skilled in the art that various other forms of sensors may be used, including, proximity switches, mechanical switches with "feelers", etc.

Referring particularly to FIGS. 14 and 20, the motor 27 for moving the vehicle on its tracks may be a direct current, variable speed electric motor. Drive unit 46 for driving the chains consists of a direct current motor 46$^a$ and alternating current motor 46$^b$. The motor 46$^a$ drives a gear box 46$^c$ having an output shaft 46$^d$. An electric clutch 46$^e$ is interposed between the shaft 46$^d$ and a shaft 46$^f$ of motor 46$^b$. The alternating current motor 46$^b$ drives into a gear box $46^g$, the output shaft of which, as shown in FIG. 14, drives the shaft 48 through the belt 47 as already explained. As will be understood, the direct current motor 27 is reversible and capable of being driven at different speeds. This permits the vehicle to traverse the rails in both directions, and at different speeds in either direction.

The direct current motor $46^a$ is uni-directional and capable of being operated at different speeds. Alternating current motor $46^b$ is reversible with regard to direction but of fixed speed. Thus, with the combinations of motors, clutches and speeds as set forth, it will be seen that the vehicle 19 may be traversed up and down the track by means of the motor 27 at variable rates of translatory movement. The live deck may be driven in a feed direction that is, in a direction to feed a module on the vehicle toward the disperser unit by means of the DC motor $46^a$. It will be understood, of course, that when motor $46^a$ is energized the clutch $46^e$ connects the drive train together so that the power for motor $46^a$ is through the train to the gear box $46^g$. The alternating current motor $46^b$ is of fixed speed but is reversible and is operated only when the clutch $46^e$ is disengaged. Referring again to FIG. 20 of the drawing energy for the system may be supplied through the lines 52 and 53. For the purpose of this illustration it will be assumed that lines 52 and 53 carry both alternating current and direct current. Under control of certain mechanism is a motor 54 for operating the conveyor 16 of the module dispersing unit 10. Motor 54 is under control of a switch 56 by which motor 54 is held energized until such time as the signal from photocell PC4 is interrupted. A switch 57 is provided in the circuit as shown to permit operation of the conveyor 16 in the feed direction, even after withdrawal of the module handling apparatus 19. Motor $46^a$ is under control of a push-botton switch 58 and another switch 59 in circuit as illustrated in FIG. 20. As shown in FIG. 20 clutch $46^e$ is only activated when motor $46^a$ is activated. That is to say, only when motor $46^a$ is energized is the electromagnetic clutch $46^e$ energized to engage it, thus only in the case of energization of motor $46^a$ to connect it in the drive chain. At other times, namely, when clutch $46^e$ is deenergized, motor $46^a$ is not in the drive chain. In FIG. 20 the motor $46^b$ is shown as having sets of windings, the entire motor being indicated by the dotted box surrounding those windings. In circuit with the forward winding 61 of motor $46^a$ are the photocells PC4 and PC1. A switch 62 is in circuit with photocells PC1 and PC4 while a switch 63 is provided to by-pass photocell PC1. The reverse winding 64 of motor $46^b$ is connected to include the photocells PC3 and PC2 and a push-button switch 66. A circuit is provided which includes a push-button switch 67 ganged as illustrated by the dotted line 68 with another push-button switch 69 to be described later. Motor 27 also is provided with a forward winding 71 and a reverse winding 72. The winding 71 is in circuit with photocells PC2 and PC3 as well as photocell PC5. Push-button switch 73 is included in the circuit with the photocells PC2, PC3 and PC5. However, the switch 69, ganged to switch 67, by-passes photocell PC5 and switch 73 whenever both switches 67 and 69 are closed. The reverse winding 72 for motor 27 is in circuit with the photocells PC4 and PC1. A push-button switch 74 controls the circuit and a switch 76 ganged with switch 63 as indicated by the line 77 is capable of by-passing photocell PC1. It will be noted that push-button switches 56, 58, 62 and 74 are ganged as illustrated by the dotted line 78.

From the foregoing the method of operating our improved apparatus may now be more fully explained and understood. When power is applied across lines 52 and 53 the four photocells are powered. These photocells "look" across the path of the module and/or the vehicle 19. The photocells PC1, PC2 and PC4 sense the presence or absence of a module while photocell PC3 senses the vehicle itself. Depressing the ganged switches 56, 58, 62 and 74 causes vehicle 19 to move away from the disperser unit 10 while the live deck chains 43 are moving toward the disperser. Since the surface speeds of each is the same, the resulting ground speed of the live deck 43 is zero. It will be seen that the disperser chain 16 is under control of this same series of switches unless switch 57 is in the closed position. The variable speed drive $46^a$ is deenergized and disengaged when the ganged switches are depressed. Switch 59 should be placed in the open position so that this condition remains true when the push-button switches just mentioned are released. If switch 63 is open when the vehicle 19 gets completely under the first module, so that photocell PC1 beam is blocked, the contacts of PC1 open, thus to deenergize the moving chain and the wheels of the vehicle. If switch 63 is closed, then the vehicle will continue until either the push buttons are released or switch 63 is opened. It will be noted that the just described operation would be desirable to shuttle modules forward as depicted in the sequence of operation, FIG. 9. Let it now be supposed that the vehicle is controlled to stop under the first module that it reaches. In this case to bring the vehicle forward switch 73 is depressed and this energizes the winding 71 of motor 27. Were there no module ahead of the vehicle, switch 73 could be held depressed until PC2 or PC3 (normally PC2) beam is broken, thereby stopping the vehicle with the module in close proximity to the dispersing cylinders or workers 13. The module now is fed into the disperser rollers by closing switch 59, thus energizing the moving chain variable speed drive $46^a$. When traversing away from the disperser, if the vehicle 19 had passed beneath a module or modules (by closing switch 63 and holding switch 46 depressed) and allowed to stop under a remote module, then that module could be transported forward as before by depressing switch 73 thus to traverse the vehicle forward with the module. When the module being carried is next to the module closest to the disperser, the vehicle can be withdrawn by depressing switch 67 to energize the reverse winding 64 of the motor $46^b$. The forward winding 71 of motor 27 is energized thus allowing chains 43 to run toward the disperser and the vehicle in a direction away from the disperser so that the relative travel of the chain with respect to ground is zero.

To advance the vehicle forward to pick up the module closest to the disperser and one that is between the vehicle and the disperser, ganged switches 67 and 69 are closed, thus to energize windings 64 and 71 of the respective motors $46^b$ and 27. This causes the vehicle to pass under the module or modules while these push buttons are held depressed until the vehicle is beneath the module closest to the disperser. When the ganged switches 67 and 69 are released switch 73 is depressed bringing the module toward the disperser. When photocell PC5 is blocked by a module ahead of the vehicle its contacts open to stop the vehicle. Switch 73 may now be released placing the module on the vehicle against the module ahead of it. If there were no module ahead of the vehicle then photocell PC2 automatically would stop the forward progress of the vehicle. Switch 59 is now closed energizing clutch 46$^{e}$ and the variable speed chain drive 46$^{a}$. If there is a module already on the chain 16, then the variable speed drive should be so adjusted that both are running at the same speed.

From the foregoing it will be seen that we have devised an improved apparatus for handling modules of seed cotton or the like. Our invention incorporates substantially all of the good points of both the fixed and movable disperser type units and eliminates many of the major objections of both of them. It will be especially noted that our invention is characterized by the fact that the vehicle can proceed under a module or a row of modules, that it can load a module from either end and discharge a module from either end.

While we have shown our invention in but one form, it will be obvious to those skilled in the art that it is not so limited, but is susceptible of various changes and modifications without departing from the spirit thereof.

What we claim is:

1. Apparatus for substantially uninterruptedly dispersing discrete modules of seed cotton or the like comprising:

(a) a receiving station having a supporting surface for modules, (b) a disperser mounted in position to engage the ends of said modules and disperse the same, (c) a low profile shuttle vehicle adapted for reciprocable travel along said receiving station toward and away from said disperser, and (d) a reversible conveyor carried by said vehicle and adapted for reciprocable movement relative thereto in the direction of travel of said vehicle with said vehicle and its conveyor being of a height and constructed and arranged to travel under, lift for transport, and transport said modules sequentially endwise into said disperser and to pick-up and discharge each of said modules from either end of said conveyor.

2. Apparatus as defined in claim 1 in which the receiving station is sized to receive simultaneously at least two end-to-end modules.

3. For use in picking up a module of seed cotton or the like from a first position on a supporting surface and delivering it to another position on a supporting surface, (a) a low profile wheeled vehicle adapted for reciprocable travel between said first position and said another position, and (b) a reversible driven module supporting conveyor mounted on said vehicle for movement relative thereto in the direction of travel of said vehicle with said vehicle and its conveyor being of a height and constructed and arranged to travel under a module from either end of said conveyor and discharge the module from either end thereof and transport said modules sequentially endwise into said disperser.

4. For use in delivering modules of seed cotton or the like to a disperser, (a) a low profile, driven vehicle disposed for reciprocable translatory movement from a module pick-up position on a supporting surface to a position with an end of a module presented to said disperser, (b) a reversible live deck type conveyor mounted on said vehicle for movement relative thereto in the direction of travel of said vehicle and having module supporting elements adapted to receive and support a module thereon with said vehicle and its conveyor being of a height and constructed and arranged to travel under, lift for transport, and transport said modules sequentially endwise into said disperser and to pick-up and discharge each of said modules from either end of said conveyor, and (c) means to drive said conveyor with its module supporting elements moving at a speed relative to the translation of said vehicle to produce a substantially zero speed relationship between said elements and a module to be picked up.

5. In apparatus for delivering modules of seed cotton to a disperser, (a) a receiving station having a supporting surface extending in alignment with the front of said disperser and of a length temporarily to store a plurality of modules in end-to-end relation relative to the entry into said disperser, (b) a low profile vehicle reciprocable along said receiving station, (c) a reversible, endless driven conveyor mounted on said vehicle with its upper flight movable in the direction of travel of said vehicle and disposed to pick-up and discharge modules from either end thereof, (d) means to reciprocate said vehicle and drive said conveyor at relative speeds resulting in substantially zero movement between said conveyor and a module being loaded onto said vehicle, and (e) said vehicle and conveyor carried thereby being of a height and constructed and arranged to run under and thus load a module located distantly from said disperser, move the same to a position closer to said disperser, and discharge the module into said disperser from the end of said vehicle opposite the end thereof onto which the module was loaded.

6. The combination of claim 5 in which said disperser has disperser elements and a feed conveyor adjacent thereto for at least a remnant of a module, whereby upon delivery of at least a portion of a module into the disperser by said vehicle, the remnant thereof may be fed into the disperser by said feed conveyor, permitting the vehicle to return for another module while the remnant is being dispersed.

7. In combination, (a) a stationary seed cotton module disperser having disperser elements and a front opening sized to receive at least an end of a module, (b) a multiple module receiving station having a supporting surface for modules thereon in front of said disperser, (c) a low profile driven vehicle mounted for reciprocable movement along said receiving station and carrying a reversible driven endless conveyor having an upper flight movable in the direction of travel of said vehicle and adapted to pick-up and discharge a module from either end of said vehicle, (d) said vehicle and its conveyor being of a height and constructed and arranged to run under and load a module from one end thereof and to discharge the module selectively either from the end onto which it was loaded or from the end opposite the end from which it was loaded, and (e) said vehicle and conveyor also being constructed and arranged for at least one end thereof to enter the front opening of said disperser, thereby to present an end of a module carried by the vehicle to said disperser elements.

8. Apparatus as defined in claim 7 in which stop means limits the travel of the vehicle into the opening of said disperser, thereby preventing entanglement of the vehicle with said disperser elements.

9. Apparatus as defined in claim 7 in which there is means to indicate when the module is clear of said vehicle, thereby indicating that the module is at least substantially unloaded, permitting the vehicle to be retracted or moved away from said disperser.

10. Apparatus as defined in claim 7 in which said vehicle carries sensing means effective to indicate the presence of another module when said vehicle is traveling toward said disperser.

11. Apparatus as defined in claim 7 in which there is means on said vehicle indicating when said vehicle is substantially completely beneath a module being loaded.

12. Apparatus as defined in claim 8 which incorporates sensing means indicating when one side of a module being transported by said vehicle aligns with a predetermined position along said supporting surfaces.

13. Apparatus as defined in claim 3 in which the wheeled vehicle runs on a guide track system that is so constructed that the top of said supporting surface and any track sections on at least one partial side of the module supporting surface are located at substantially the same elevation so that a module can be deposited on the supporting surface out of alignment with the travel of the vehicle and later be pushed laterally across the supporting surface into alignment with the vehicle.

14. Apparatus as described in claim 6 in which automatic sensing and actuating means are provided to cause said vehicle to advance all modules present within the system to their respective closest possible positions to said disperser and to automatically abut each succeedng module directly behind the preceding module remnant in said disperser.

15. Apparatus as described in claim 14 in which the automatic means contains circuitry to preempt the control of said vehicle whenever said remnant length in said disperser indicates another control command would cause said remnant in said disperser to become too short by the time said vehicle could move back toward said disperser and abut the succeeding module behind said remnant.

16. Apparatus as described in claim 6 in which there is means to indicate when the trailing side of the module remnant in said disperser has reached a predetermined minimum distance from said disperser elements and no succeeding module is abuted against said remnant.

* * * * *